United States Patent [19]

Dionne

[11] 3,949,435

[45] Apr. 13, 1976

[54] SUPPORT FOR USE WITH BED RIDDEN PATIENTS

[75] Inventor: David James Dionne, Pittsboro, N.C.

[73] Assignee: Terry Roberts, Albemarle, N.C. ; a part interest

[22] Filed: Apr. 10, 1974

[21] Appl. No.: 459,607

[52] U.S. Cl. ..... 5/327 R; 297/439

[51] Int. Cl.[2] ..... A47C 21/00

[58] Field of Search ..... 5/82, 114, 186, 317 R, 5/319, 320, 327 R; 297/438, 439, 453

[56] References Cited

UNITED STATES PATENTS

| | | | |
|---|---|---|---|
| 2,602,171 | 7/1952 | Good | 5/319 |
| 2,716,443 | 8/1955 | Laughlin | 5/327 R |
| 2,836,833 | 6/1958 | Carlson | 5/327 R |
| 2,907,376 | 10/1959 | Lilienfeld | 5/186 R |
| 2,972,755 | 2/1961 | Abel | 5/82 |
| 3,538,522 | 11/1970 | Adams | 5/327 R |

*Primary Examiner*—Casmir A. Nunberg

*Attorney, Agent, or Firm*—Mills and Coats

[57] ABSTRACT

In abstract, a preferred embodiment of the present invention is an adjustable support frame for bed ridden patients covered with a removable, resilient supportive material.

6 Claims, 8 Drawing Figures

SUPPORT FOR USE WITH BED RIDDEN PATIENTS

This invention relates to medical appliances and more particularly to support devices for bed ridden patients to either prevent, or after they have occurred, to cure bed sores.

Ulcerated tissue commonly known as bed sores are caused by the effective areas being deprived of nutrition by prolonged pressures thereon. These ulcerations are usually caused by prolonged bed contact particularly in boney areas such as the spine and hip bone in patients who are bedfast for long periods. To prevent this condition, or to aid in the curing thereof once it has occurred, many devices and contraptions have been devised. These various means have not been considered satisfactory, however, and the age old accepted practice of every few hours moving the patient to a different position is almost universally used. This practice of moving the patient who is incapable of moving himself requires almost constant attention to the patient and certainly requires the availability of an attendant at regular intervals of relatively short separation.

Not only is the practice of moving the patient burdensome because of the regularity of the need but also at today's high cost of medical attendance, it is extremely expensive.

The above notwithstanding, the accepted practice of constantly changing the position of the patient to remove pressure from areas prone to ulcerations is only partially affective at best. Thus it can be seen that a great need lies in the area of an affective means for preventing bed sores in patients, and where the same do occur, a means for aiding in the curing or healing thereof.

After much research and study into the above mentioned problems, the present invention has been developed which provides a means for distributing the weight of a bedfast patient over a wide area thus relieving limited areas from ulcerations from excessive pressure. This invention is in the form of a support frame having stretched therearound a resilient fabric such as nylon netting or webbing. The invention allows sore curing ambient air to circulate all around the patient while he is still lying in bed. The device of the present invention can be used with any conventional bed without modification of the same and the invention can also be adjusted for heavier or lighter patients as well as for the height that the patient is supported above the bed.

The present invention also meets sanitation requirements by being removable for washing while at the same time is made of a material which is impervious to absorption of secretions such as sweat, body waste or the like.

In view of the above, it is an object of the present invention to provide a means for allowing a patient to remain in relative comfort on his own bed without running the risk of the development of bed sores due to certain areas of the body becoming deprived of nutrition and thus becoming ulcerated.

Another object of the present invention is to provide an invalid support for bed ridden patients which aids in the curing of bed sore type ulcerations once they have developed and prevents the same from reoccurring.

Another object of the present invention is to provide a bed sore prevention and curing means which is adjustable to accommodate patients of diverse weight.

Another object of the present invention is to provide a support for bed ridden patients which is readily removable for cleaning while at the same time being impervious to deep fiber absorption.

Another object of the present invention is to provide a means for supporting a bed ridden patient to allow complete air circulation about the body.

Other objects and advantages of the present invention will become apparent and obvious from a study of the following description and the accompanying drawings which are merely illustrative of such invention.

Figure 1:
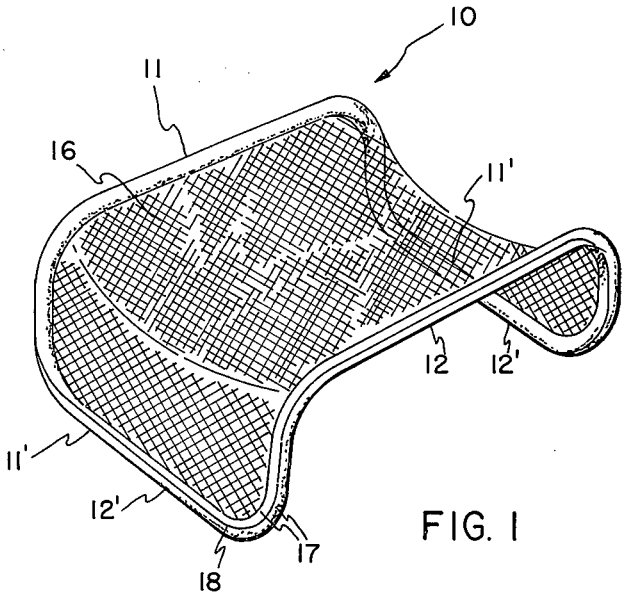
FIG. 1 is a perspective view of the support of the present invention.
Figure 2:
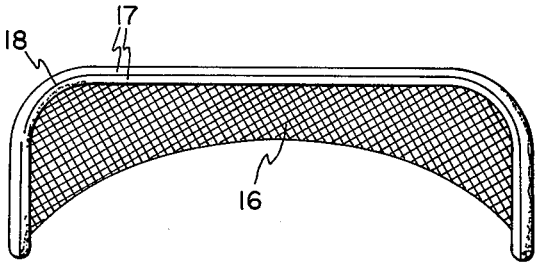
FIG. 2 is a side elevational view of such support.

With further reference to the drawings, the support of the present invention, indicated generally at 10, is composed of a pair of generally U-shaped frame members 11 and 12 whose end portions 11' and 12' are curved perpendicular thereto. As can clearly be seen in the drawings, the end portions 11' and 12' act as surface engaging support rails for the support device.

Figure 6:
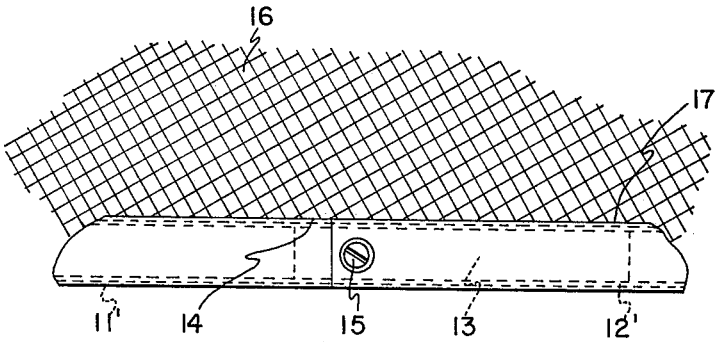
FIG. 6 is a detailed fragmentary view of the tension adjustment means.
Figure 7:
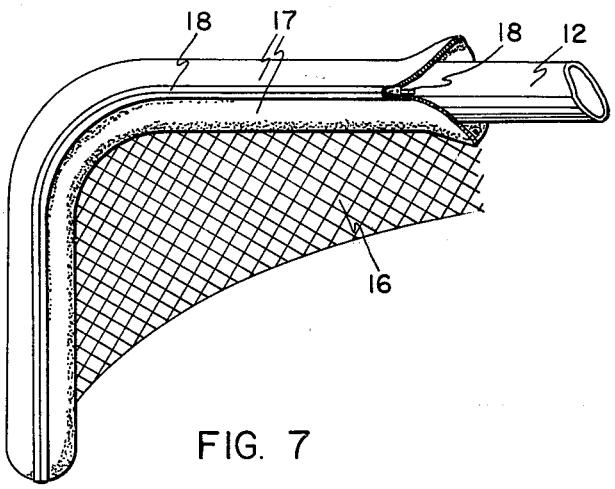
FIG. 7 is a detailed fragmentary view of the securing means for the fabric used in conjunction with the present invention.
Figure 8:
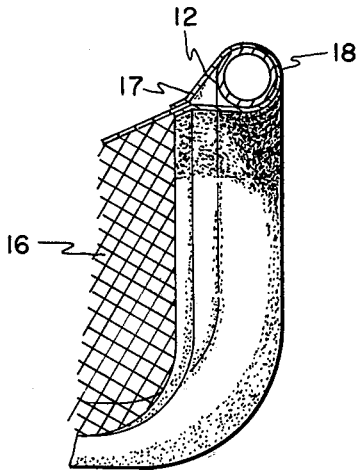
FIG. 8 is an enlarged fragmentary view showing how the fabric is supported by the frame.

As seen in FIG. 6, the two frame members 11 and 12 are connected by way of a dowel 13 disposed interiorly of joining end portions 11' and 12'. These dowels, one on each side of the support device are preferably fixedly secured in one end portion by means such as a dimple 14 and are slidably adjustable within the adjoining frame end portion with the adjustment being secured by means such as set screw 15.

A resilient flexible fabric 16 such as the netting formed of nylon is provided to support the body of the patient. This fabric has secured about its periphery of stitching, heat fusion or other suitable means to a reinforced border area 17. This border is preferably composed of a stretch type fabric to further aid in the even distribution of the weight of the patient cross fabric 16 when the support device of the present invention is in use.

Along the longitudinal edge of border 17 can be provided a releasable closure means such as zipper 18. This zipper is preferably of the type that is separable at its end so that the fabric can be readily and quickly removed from the jointed frames of the support.

Although a zipper closure is shown, it is, of course, obvious that other methods of releasable securing such as velcro, snaps, eyelets, or the like could be used.

Figure 3:
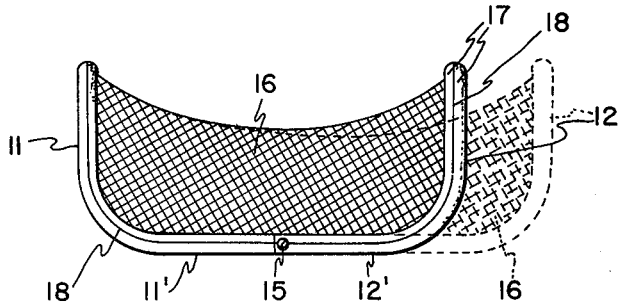
FIG. 3 is an end elevational view of the same showing the tension adjustment means.
Figure 4:
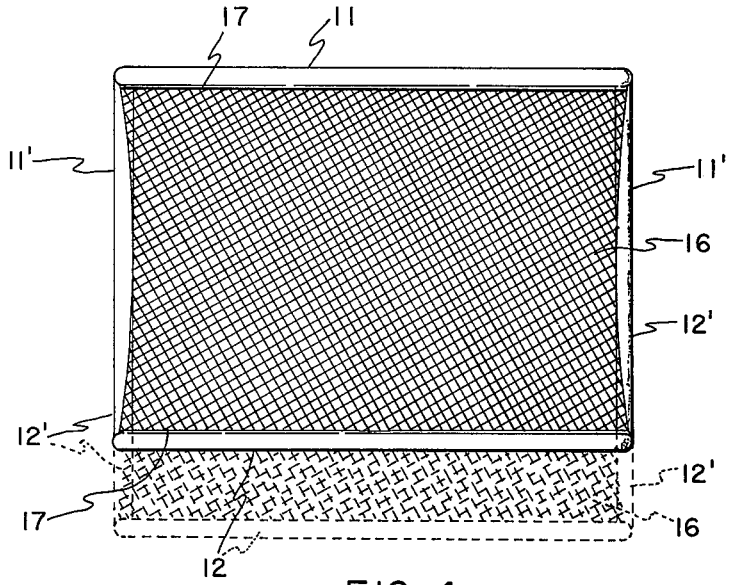
FIG. 4 is a top plan view of such support.
Figure 5:
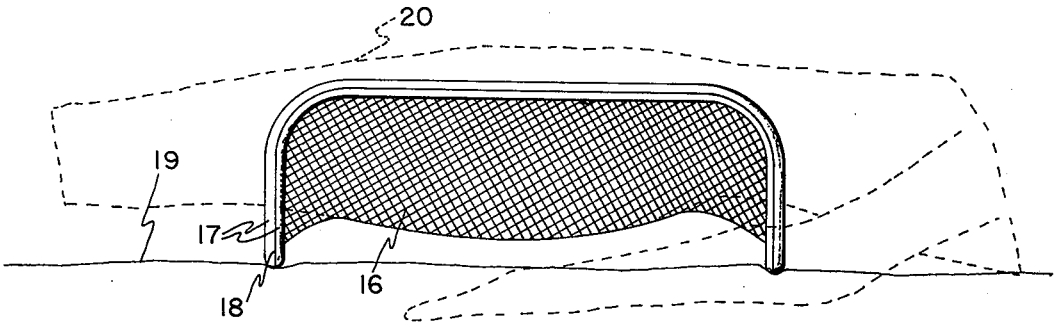
FIG. 5 is a side elevational view of the device of the present invention showing its manner of use with a patient.

When the craddle type support device of the present invention is to be used, it can be placed on the bed of the patient with the end portions 11' and 12' being disposed transversely thereacross. The patient is then lifted onto the craddle with the buttocks and central portion of the body being supported thereby. Due to the give in the border fabric 17 as well as in the mesh fabric 16, an even distribution of weight cross all portions of the body as provided. The height of the patient 20 above the bed surface 19 is adjusted by moving the frame members toward or away from each other by sliding the same on dowel 13 and then setting the adjustment through use of set screw 15. These adjustments are clearly seen in FIGS. 3 and 4 and obviously the tighter the fabric 16 is pulled the more lift it will provide.

Once the patient has been placed in the support craddle and the height adjustment (which needs only to be slightly above surface 19) is made, the patient can be left without movement for extended periods of time thus reducing the attendant care required. As with all patients, some movement periodically is required to assure proper blood circulation to muscles and interior organs but this is separate and apart from the problem of preventing or curing bed sores. Since the patient is held in a space relationship from surface 19 and is supported with equal pressure across a large area of body, ulceration preventing and curing ambient air circulation is provided.

Since most bed sheeting is relatively porous, the same can be used over the support craddle of the present invention without adversely affecting the effectness of the present invention. For sanitary purposes, the use of standard bed sheeting is in most cases desirable. Also, this cuts down on the ofteness of the fabric 16 having to be removed for cleaning.

Although other types of fabric can obviously be used, one of the most advantageous types available in the present state of the art is nylon type mesh fabric. The fibers of this fabric are impervious to absorption and yet have the required elasticity.

From the above, it is obvious that the present invention has the advantage of providing a relatively inexpensive and yet highly efficient means for either preventing or curing ulcerations caused by prolonged pressures on the body of bedfast patients. The present invention also has the advantage of providing an easily cleaned, bed sore preventing device which is readily useable in conjunction with the regular bed of the patient. The present invention also has the advantage of being disassembleable for storage in a confined area and yet provides a sturdy support when in use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A device for the cure and prevention of ulcerated tissue on the body of a patient who is bed ridden for a prolonged period of time comprising: an extensively adjustable, endless frame means adapted to be disposed on the surface of the bed of the patient, said frame having at least one raised portion disposed in spaced relationship to said bed; and a body supportable, stretchable, air permeable fabric removably secured completely about said endless frame in such a manner as to support the body of the patient in spaced relation to said bed surface whereby the weight of the patient is evenly distributed over a large body area and ambient air is allowed to circulate therearound.

2. The device of claim 1 wherein the frame is extensibly adjustable thereby allowing variable control of the tension of the supportive fabric.

3. The device of claim 2 wherein the fabric tension control is telescopically adjustable.

4. The device of claim 1 wherein the frame includes at least two portions disposed above the bed surface, said portions being disposed on opposite sides of the patient with the fabric forming a patient supportive craddle therebetween.

5. The device of claim 4 wherein the fabric is an open meshed nylon type material.

6. The device of claim 4 wherein the fabric is removably secured to said frame.

* * * * *